US005303637A

United States Patent [19]

Nolan

[11] Patent Number: 5,303,637

[45] Date of Patent: Apr. 19, 1994

[54] PISTON ASSEMBLY STRUCTURE FOR AN HYDRAULIC CYLINDER

[76] Inventor: John E. Nolan, 417 Dorsey Way, Louisville, Ky. 40223

[21] Appl. No.: 790,121

[22] Filed: Dec. 3, 1990

Related U.S. Application Data

[62] Division of Ser. No. 393,682, Aug. 16, 1989, Pat. No. 4,996,728.

[51] Int. Cl.[5] ..... F15B 15/00

[52] U.S. Cl. ..... 92/13.41; 92/13.6; 92/165 PR; 92/242; 92/248

[58] Field of Search ..... 4/496, 504, 559, 560, 4/561, 562, 563, 564, 565, 566; 92/13.41, 109, 113, 163, 164, 165 R, 165 PR, 249, 255, 257, 242, 248; 277/24, 205, 2126

[56] References Cited

U.S. PATENT DOCUMENTS 2,976,844 3/1961 Goldring ..... 92/161
3,185,043 5/1965 Dunham ..... 92/164
3,835,753 9/1974 Bunyard ..... 92/165 PR

FOREIGN PATENT DOCUMENTS 2521364 11/1976 Fed. Rep. of Germany ... 92/165 PR

*Primary Examiner*—Glenn J. Barrett
*Attorney, Agent, or Firm*—Polster, Lieder, Woodruff & Lucchesi

[57] ABSTRACT

Portable lift structure for moving a support platform between a comparatively dry position above the surrounding deck of a liquid spa tank to a wetting position in the spa tank including two longitudinally extending structural members pivotally connected at corresponding top ends thereof to be moved between a portable and operating positions, one structural member serving as a mast to be removably mounted in the spa tank deck and the other as a platform mount, to be pivoted from above the surrounding spa tank deck to a position above the spa tank and lowered by a hydraulic cylinder and piston to a wetting position.

3 Claims, 3 Drawing Sheets

PISTON ASSEMBLY STRUCTURE FOR AN HYDRAULIC CYLINDER

This is a divisional of copending application Ser. No. 07/393,682 filed Aug. 16, 1989, now U.S. Pat. No. 4,996,728.

BACKGROUND OF THE INVENTION

The present invention relates to platform lift structure for spa tanks and pools and more particularly to portable lift structure for moving a handicapped individual from a comparatively dry position above the surrounding deck of a spa tank or pool to a position within the spa tank or pool removed from the edge thereof.

Numerous chair lift structures are known in the art for moving individuals, particularly those with handicaps, between a position located on the spa tank or pool side and a position located in the tank or pool for swimming and therapy sessions. Several U.S. patents are known to teach such structure, including U.S. Pat. No. 4,183,106, issued to G. E. Grimes, et al., on Jan. 15, 1980; U.S. Pat. No. 4,221,008, issued to J. E. Nolan on Sep. 9, 1980; and U.S. Pat. No. 4,283,803, issued to K. Krumbeck on Aug. 18, 1981. The structures of these patents and other such structures generally have been of a stationary nature, erected on the tank or pool deck closely proximate to the tank or pool side in fixed relation thereto and necessitating a lowering of the individual into the water immediately adjacent the tank or pool side. Moreover, the lift mechanism employed has often been comparatively complex in assembly, erection and maintenance and, in some instances, has even included structure designed to support and lower an individual's wheelchair into the tank or pool. Past mechanisms have often required supplementary power in the form of electric motors and pumps to operate in conjunction with the lift structures and the overall structures have occupied desirable space on the tank or pool deck, particularly when not in use for handicapped persons.

The present invention, recognizing the aforementioned limitations of past chair-lift structure, provides a new and novel structural arrangement for chair lifts and other types of platforms, which is straightforward and economical in manufacture, assembly, operation and maintenance, which requires a minimum of parts, space and weight and which can be readily collapsed and removed from the deck surface when not in use. Moreover, the present invention provides a structure which can operate on normal city or household water with simple connections and without supplementary electric motor and/or pump equipment. Further, the present invention provides a structure which requires no underwater installation, which can be readily employed in various tank or pool environments and which can insure a lowering of a platform or chair into the tank or pool at a location properly spaced from the tank or pool with improved hydraulic mechanisms.

Various other features of the present invention will become obvious to one skilled in the art upon reading the disclosure set forth herein.

BRIEF SUMMARY OF THE INVENTION

More particularly, the present invention provides a portable and collapsible lift structure for moving a support platform between a comparatively dry position above the surrounding deck of a liquid spa tank to a wetting position in the spa tank comprising: a vertical, longitudinally extending first structural member removably mounted at its lower end to the surrounding spa tank deck; a second longitudinally extending structural member having its upper end pivotally connected to the upper end of the first structural member to cantilever downwardly therefrom with the longitudinal axis of the second structural member pivotal relative the longitudinal axis of the first structural member from a substantially portable storing position to a preselected angle operating position with the opposite lower end of the second structural member spaced a preselected distance from the lower end of the first structural member and above the surrounding spa tank deck; a support platform connected to the second structural member adjacent the lower end to extend in a generally horizontal plane in the comparatively dry position above the surrounding spa tan deck; means to maintain the second structural member in the downwardly cantilevered preselected angle position relative the first structural member; means to allow rotation of the support platform from the comparatively dry position above the supporting spa tank deck to a position above the liquid spa tank spaced from the edge of the surrounding spa tank deck; and, means to lower and raise the support platform when in such position above the liquid spa tank to and from a wetting position in the spa tank. In addition, the present invention provides a novel arrangement for rotating the first structural member and a novel hydraulic cylinder and piston arrangement which serves to minimize fluid leakage and utilize ambient air pressure to assist outward or downward piston movement. It is to be understood that several changes can be made in one or more of the several parts of the structure disclosed herein by one skilled in the art without departing from the scope or spirit of the invention.

BRIEF DESCRIPTION OF THE DRAWINGS

Referring to the drawings which disclose one advantageous embodiment of the present invention.

DETAILED DESCRIPTION OF THE DRAWINGS

Figure 1:
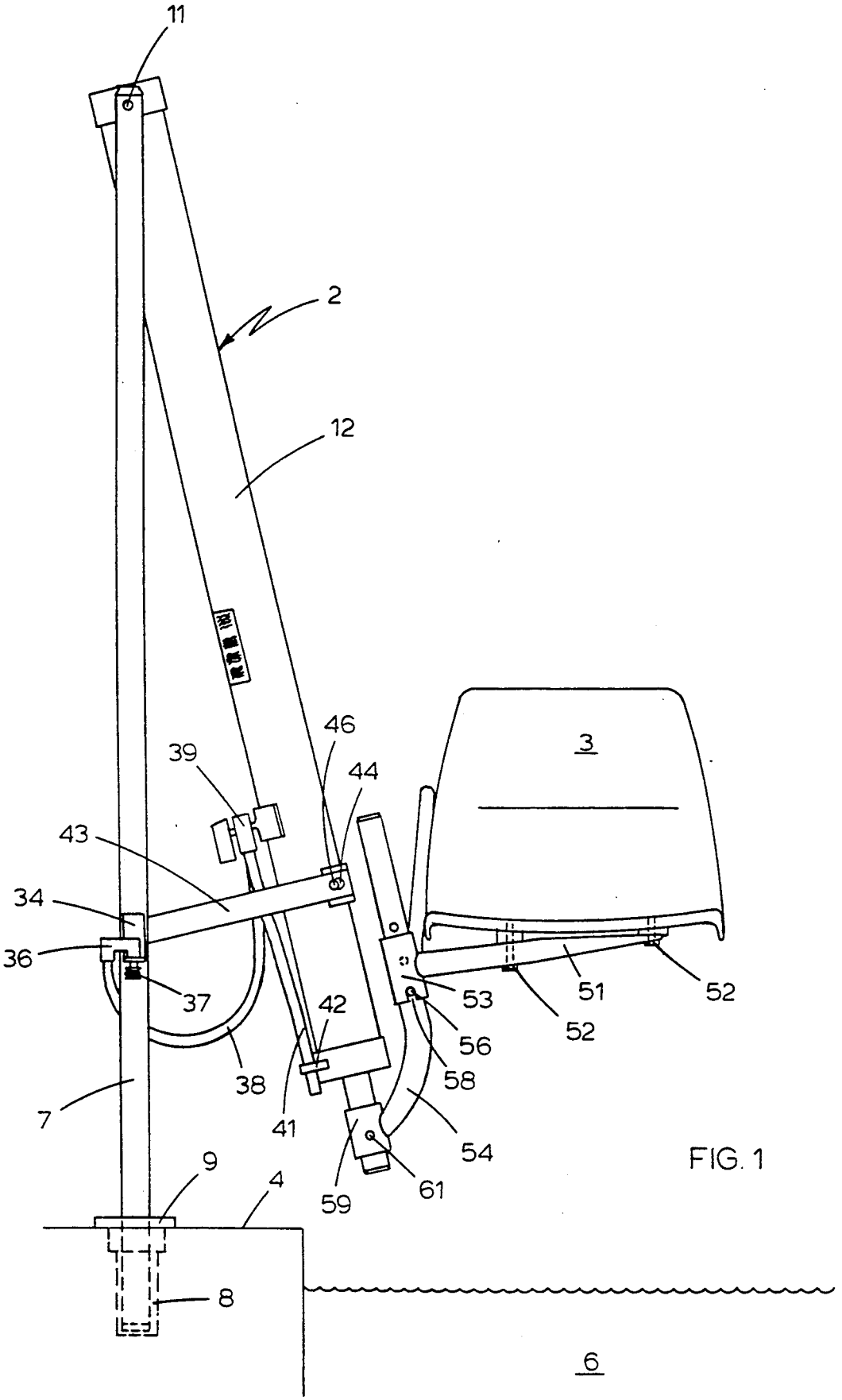
FIG. 1 is a front end view of the novel portable lift structure for a support platform in the form of a chair.

Referring to FIG. 1, the portable lift structure, generally referred to in the drawings by reference numeral 2, is disclosed. Lift structure 2 described in detail hereinafter serves to move a support platform, in the form of chair 3 from a comparatively dry position above the surrounding spa tank deck 4 of a liquid spa tank 6 to a wetting position in the spa tank.

Figures 2, 2A:
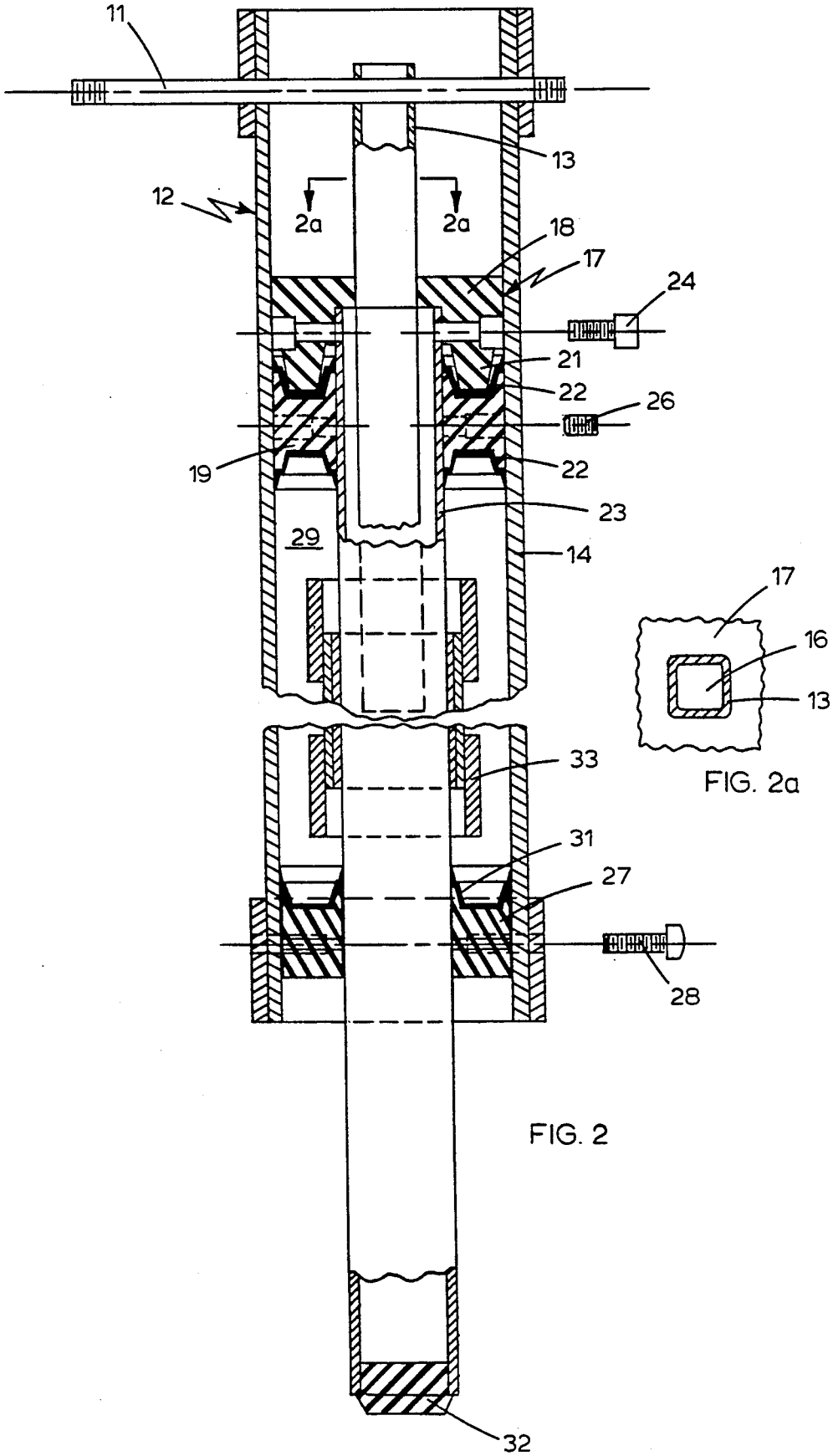
FIG. 2 is an enlarged cross-sectional view of the hydraulic cylinder and piston assembly of FIG. 1.
FIG. 2*a* is a cross-sectional view of the key member of FIG. 2 taken in a plane through line 2*a*—2*a* of FIG. 2 to disclose the rectangular cross sectional configuration.

Portable lift structure 2 includes a vertically extending mast 7 made from a suitably strong, rigid tubular metallic material, such as stainless steel, the mast being of sufficient thickness and strength to readily support the hydraulic cylinder and piston, chair, auxiliary equipment associated therewith and a very heavy handicapped person who might be using such chair, all of which supported items are suspended from the top of the mast in a manner described hereinafter. The lower end of the mast 7 is suitably sized to rotatably engage in an appropriate socket 8, embedded in the spa tank deck, which deck is usually of a reinforced cement, concrete or aggregate material. Advantageously, the socket should have a depth of at least six (6) inches and should be located six (6) to fourteen (14) inches from the edge of spa tank deck 4. The socket can be made from a suitable wear and corrosion resistant material, such as bronze, to provide a smooth internal surface to allow easy, manual rotation of the mast 7 about its longitudinal axis. A suitable socket cover 9 surrounds mast 7 to cover the socket 8 and to enhance support of mast 7, further preventing seepage of liquid into the socket. The mast 7 which can be of a suitable height, for example, six and one-half feet (6½") from the surrounding spa tank deck 4, is provided with a top stud 11 at the upper extremity thereof which stud 11 extends transversely to the longitudinal axis of mast 7. Pivotally mounted on stud 11 are the upper end of a longitudinally extending hydraulic cylinder and piston assembly 12 and a longitudinally extending key member 13 which is disposed in cylinder 14 of cylinder and piston assembly 12 to extend along the longitudinal axis thereof (FIG. 2). Key member 13 can be of rectangular cross-sectional configuration to pass through a conforming rectangular aperture 16 in piston 17 to permit and guide slidable movement of the piston 17 relative cylinder 14 and to prevent rotation of piston 17 relative cylinder 14 (FIG. 2*a*). Both cylinder 14 and key member 13 can be made of a suitable, lightweight, corrosion resistant material such as a hard, sturdy plastic material. Piston 17 can be made from a suitable composition material, such as a hard, flexible, corrosion resistant rubber or plastic. It is to be noted that piston 17 includes an upper piston section 18 and a lower piston section 19, with the ringlike tapered rim shape or seal 21, provided along the undersurface of upper piston 18 engaging in dovetailing fashion with the ringlike tapered cup shape 22, provided in both the upper surface and undersurface of lower piston 19. The upper piston 18 along with lower piston 19 serves to ensure that there is no leakage of air into the cylinder chamber 29 during fluid drainage operations. Upper piston section 18 in turn has the upper end of hollow piston rod 23 fastened thereto by radially extending cup screw 24, which extends radially through the side wall of section 18 and engages piston rod 23. Lower piston 19 is held to piston rod 23 by a suitable radially extending set screw 26 which extends radially through lower piston section 19 to be tightened firmly against hollow rod 23. It is to be understood that several such screws 24 and 26 can be used in radially spaced relation around the upper portion of rod 11 to firmly fasten the piston sections 18 and 19 to rod 23. It is further to be noted that hollow cylinder 14 is provided with a lower guide and seal 27 which is fastened to cylinder 14 by a suitable number of radially extending spaced screws 28 passing through the wall of cylinder 14 radially into the side walls of lower guide and seal 27. This guide and seal 27, which can be provided with an upper cup-shaped surface 31 and which can be made of a material similar to that used for piston sections 18 and 19, serves to seal fluid chamber 29 defined between the lower cup-shaped surface 22 of lower piston section 19 and the cup-shaped upper surface 31 of guide seal 27, guide seal 27 being appropriately apertured to allow hollow piston rod 23 to piston rod 23 is provided with a suitable plug 32 to prevent the entrance of fluid into the hollow piston rod. Disposed within fluid chamber 29 to loosely surround piston rod 23 is a sturdy, light hollow downstop sleeve 33, which can be made of a suitable, corrosion resistant, plastic material, the opposed ends of sleeve 33 engaging in opposed cups 22 and 31 of opposed lower piston section 19 and guide and seal 27 to limit the downstroke of piston 17 and thus the downward movement of piston rod 23 attached thereto.

Referring to FIG. 1 of the drawings, it can be seen that mast 7 has mounted thereon at a readily accessible position above surrounding deck 4 a bracket 34 serving to support fitting assembly 36 which has an externally threaded inlet plug 37 to which the internally threaded plug end of a suitable garden hose (not shown) can be connected for introduction of fluid, such as city water (usually at a pressure approximately of fifty (50) psi). Fitting assembly 36, in turn, is connected to one end of a supply hose 38, the other end of hose 38 being connected to a three-way valve assembly 39 mounted on cylinder 14 and which, when in a first (up) position, allows introduction of fluid into fluid chamber 29 of cylinder 14 to slidably move piston 17 and piston rod 23 in an upward direction along the longitudinal axis of cylinder 14. Valve assembly 39 can then be moved to a second position (stop) to stop the fluid flow into fluid chamber 29 and hold piston rod 23 at any preselected desired upper position. When valve assembly 39 is moved to a third "drain" (down) position, fluid is passed from chamber 29 through valve assembly 39 to a drain hose 41, fastened to cylinder 14 by hose clamp 42, and into liquid spa tank 6 where it is appropriately collected, the piston 17 and piston rod 23 moving in a downward direction along the longitudinal axis of cylinder 14 until downstop sleeve 33 engages with cup-shaped surface 22 of lower piston section 19 and cup-shaped surface 31 of lower guide and seal 27. It is to be noted that upper piston 17 and rim serves as an air seal to allow ambient air to assist downward movement of piston rod 23.

Figure 3:
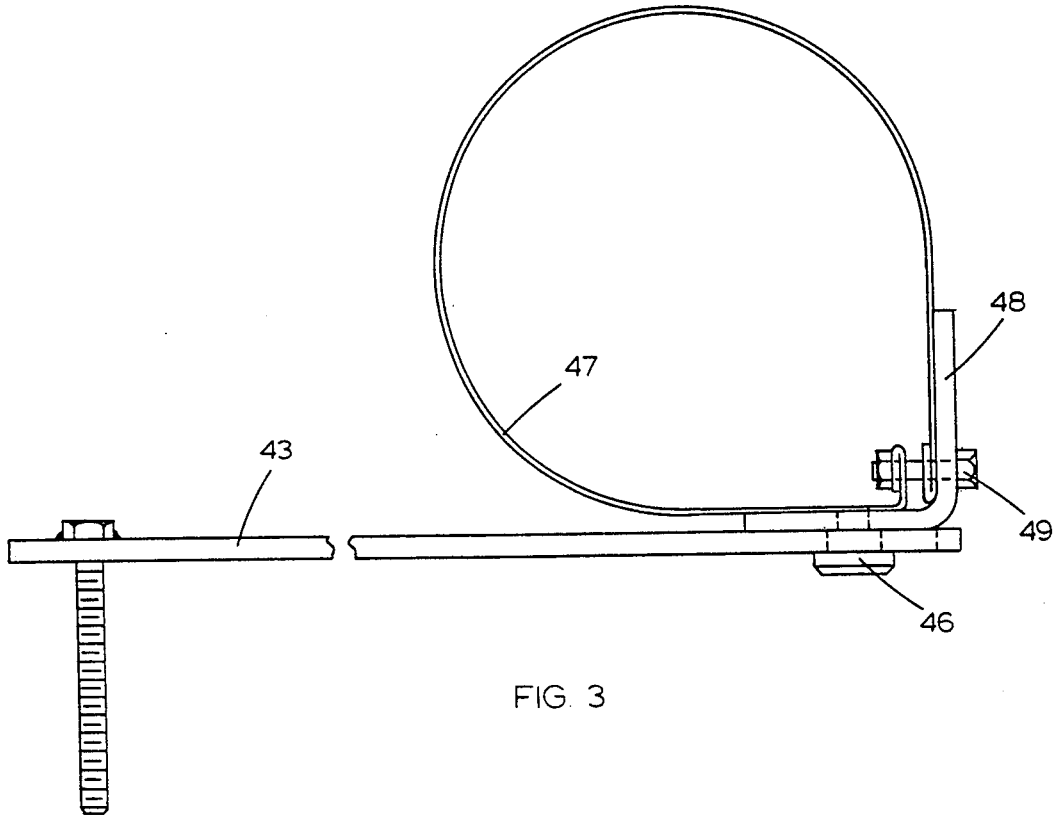
FIG. 3 is an enlarged top plan view of the clamp, keeper pin and structural bar of FIG. 1 used to hold the hydraulic cylinder at a preselected downwardly cantilevered angle relative the mast; and, FIG. 4 is a side view of the structural bar and slotted aperture therein which engages with the keeper pin of FIG. 3.
Figure 4:
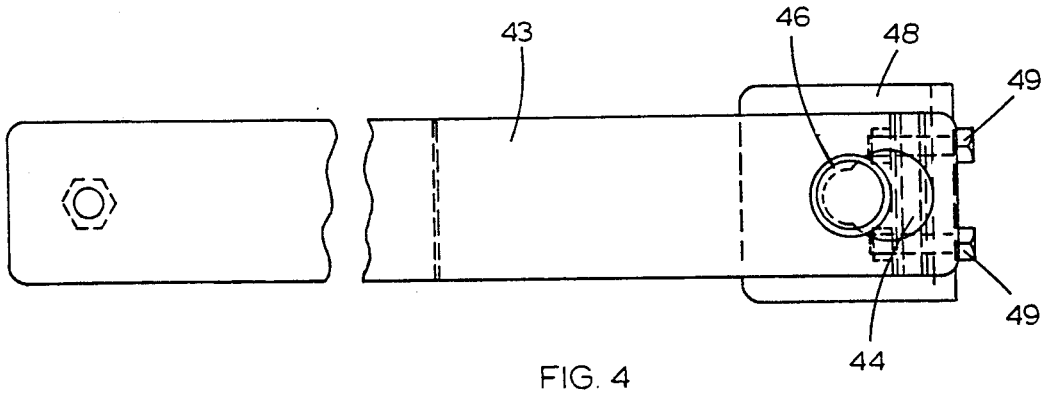

Referring to FIGS. 1, 3 and 4 of the drawings, it can be seen that when hydraulic cylinder and piston assembly 12, the second aforementioned structural member, has been pivoted to a preselected angle about top stud 11 at the top of mast 4, the first aforementioned structural member, it is maintained in such a position by a third structural member, which is in the form of a structural bar 43 pivotally connected at one end to mast 7 and having a key slot aperture 44 at the other end which engages with a mushroom head pin 46 (FIG. 3). Pin 46 is fastened to one end of an adjustable band 47 surrounding cylinder 14 by means of one leg of a right angle bracket 48, the other leg of bracket 48 has adjusting screw and nut assembly 49 fastened thereto and to the other end of adjustable band 47 to allow adjustable tightening of band 47 around cylinder 14 with engaged pin 46 in the key slot aperture 44 of bar 43 holding cylinder 14 of cylinder and piston assembly 12 at a preselectively downwardly cantilevered angle relative mast 7.

Again referring to FIG. 1 of the drawings, it can be seen that the support platform in the form of chair 3 is removably supported on a seat base assembly 51 by means of screws 52 which fasten the undersurface of the seat of chair 3 to seat base assembly 51. One end of seat base assembly 51 is provided with an integral hollow cylindrical sleeve 53 which telescopically engages with an upwardly cantilevered portion of angular cylindrical post member 54, this cantilevered portion extending in spaced parallel relation to cylinder 14. Suitable seat lock bolts 56 can be provided to selectively extend through any one of several spaced through apertures in post member 54 and engage with opposed slots 58 provided along the lower edge of sleeve 53 to hold sleeve 53, seat base assembly 51 and chair 3 supported thereon in a selected adjusted position on post 54. Post 54 in turn is provided at its lower most angled portion with a hollow cylindrical sleeve 59 which telescopically engages with the lowermost portion of piston rod 23 to be fastened thereto by bolt and nut assembly 61.

Thus, in accordance with the above described structure, a unique, straightforward, and economical portable lift structure for moving a support platform in the form of a chair efficiently between dry and wetting positions is provided. This novel structure provides for a minimum exposure to spa tank water of its several exposed parts and can be readily assistant-operated, collapsed and removed when not in operation.

The invention claimed is:

1. In a fluid pressure responsive longitudinally extending annular hydraulic cylinder having an inner chamber with a piston assembly disposed therein having spaced extremities extending longitudinally and coaxially within said cylinder to define a piston cavity between said spaced extremities and having means intermediate said spaced extremities to allow introduction and removal of hydraulic fluid into said piston cavity to provide reverse strokes of a piston of said piston assembly within said inner chamber, said piston assembly having secured to one end of said pistons separate adjacent, interrelated and cooperatively slidable upper and lower piston sections extending transversely and sealingly across said inner chamber to define at least one movable extremity of said piston cavity such that a lower face of said upper piston section and an upper face of said lower piston section are mated in an interfaced tapered cup and tapered seal dovetailed relation in a manner extending substantially across the interfacing of said piston sections to provide a tortuous seal over an extended area between said slidable facing sections to insure against leakage relative said piston cavity and against the introduction of ambient air into said piston cavity during fluid drainage therefrom and the escape of fluid during fluid introduction into said piston cavity.

2. The fluid pressure responsive hydraulic cylinder and piston assembly of claim 1, wherein said hydraulic cylinder inner chamber having a guide seal positioned in said inner chamber at one extremity thereof opposite said piston sections of said piston assembly, said piston sections having a hollow piston rod fixed thereto slidably extending through said guide seal; and, a hollow stop sleeve disposed within said piston cavity of said inner chamber of said hydraulic cylinder to surround said hollow piston rod in spaced longitudinally slidable relation between said piston sections and said guide seal to limit the stroke of said hollow piston within said cylinder inner chamber.

3. The fluid pressure responsive hydraulic cylinder and piston assembly of claim 1, wherein a key member of irregular cross-section is fixed to said cylinder to slidably extend relative said piston assembly in snug slidable engagement therewith, said key member being of irregular cross-section to prevent rotation of said piston assembly relative said cylinder.

* * * * *

UNITED STATES PATENT AND TRADEMARK OFFICE

CERTIFICATE OF CORRECTION

PATENT NO. : 5,303,637

DATED : April 19, 1994

INVENTOR(S) : John E. Nolan

It is certified that error appears in the above-indentified patent and that said Letters Patent is hereby corrected as shown below:

In column 4, line 4, after the first word "to" (first appearance) the words -- slidably extend therethrough. The lower extremity of hollow --

Signed and Sealed this

Sixteenth Day of August, 1994

*Attest:*

*Attesting Officer*

BRUCE LEHMAN

*Commissioner of Patents and Trademarks*